United States Patent [19]

Jessop

[11] 3,955,373

[45] May 11, 1976

[54] TUNNELLING SHIELDS

[75] Inventor: Kenneth Gilbert Jessop, Tenterden, England

[73] Assignee: Stelmo Limited, Ashford, England

[22] Filed: Dec. 7, 1973

[21] Appl. No.: 422,811

[30] Foreign Application Priority Data

Dec. 8, 1972 United Kingdom ..... 56837/72

[52] U.S. Cl. ..... 61/85; 299/31

[51] Int. Cl.[2] ..... E21D 9/06

[58] Field of Search ..... 61/84, 85, 42; 299/31, 299/33

[56] References Cited

UNITED STATES PATENTS

| | | | |
|---|---|---|---|
| 2,139,563 | 12/1930 | Russell | 61/85 |
| 2,466,709 | 4/1949 | Karr | 61/85 |
| 3,325,217 | 6/1967 | Enz | 299/33 |
| 3,468,133 | 9/1969 | Matshushita | 299/31 |
| 3,486,794 | 12/1969 | Tabor | 61/85 |
| 3,550,389 | 12/1970 | Khodosh et al. | 61/84 |
| 3,578,809 | 5/1971 | Cunningham | 61/85 |
| 3,657,897 | 4/1972 | Krismer, Jr. | 61/42 |

*Primary Examiner*—Jacob Shapiro

*Attorney, Agent, or Firm*—Beveridge, DeGrandi, Kline & Lunsford

[57] ABSTRACT

The invention provides a tunnelling shield including a plurality of axially extending rams fixed therein for thrusting against a tunnel lining erected behind or within the rear portion of the shield, a fluid pump, a motor for driving the pump and a fluid reservoir for supplying fluid under pressure to the rams, the improvement wherein the fluid pump and the motor are mounted on the inner periphery of the shield at the bottom of the shield and at least one fluid reservoir is mounted on the inner periphery of the shield at a location spaced from the fluid pump and the motor.

6 Claims, 2 Drawing Figures

TUNNELLING SHIELDS

FIELD OF THE INVENTION

The invention relates to tunnelling shields of the type having a plurality of axially extending rams fixed therein for thrusting against a tunnel lining erected behind or within the rear portion of the shield.

BACKGROUND OF THE INVENTION

In conventional arrangements of tunnelling shields having hydraulic thrust rams, a power pack containing a hydraulic pump and motor together with a fluid reservoir are towed behind the shield. The power pack represents a considerable obstruction especially in restricted areas for example for making small diameter tunnels. Moreover, a power pack towed behind the shield is exposed to abuse in use and in particular there are hydraulic pipes extending rearwardly of the shield which are exposed and liable to breakdown under working conditions. The object of the invention is to provide an improved tunnelling shield of the aforesaid type, more suitable for use in excavating small diameter tunnels.

SUMMARY OF THE INVENTION

The invention provides, in a tunnelling shield including a plurality of axially extending rams fixed therein for thrusting against a tunnel lining erected behind or within the rear portion of the shield, a fluid pump, a motor for driving the pump and a fluid reservoir for supplying fluid under pressure to the rams, the improvement wherein the fluid pump and the motor are mounted on the inner periphery of the shield at the bottom of the shield and at least one fluid reservoir is mounted on the inner periphery of the shield at a location spaced from the fluid pump and the motor.

Conveniently the fluid pump and the motor may be located beneath the working floor of the shield.

DETAILED DESCRIPTION

Figure 1:
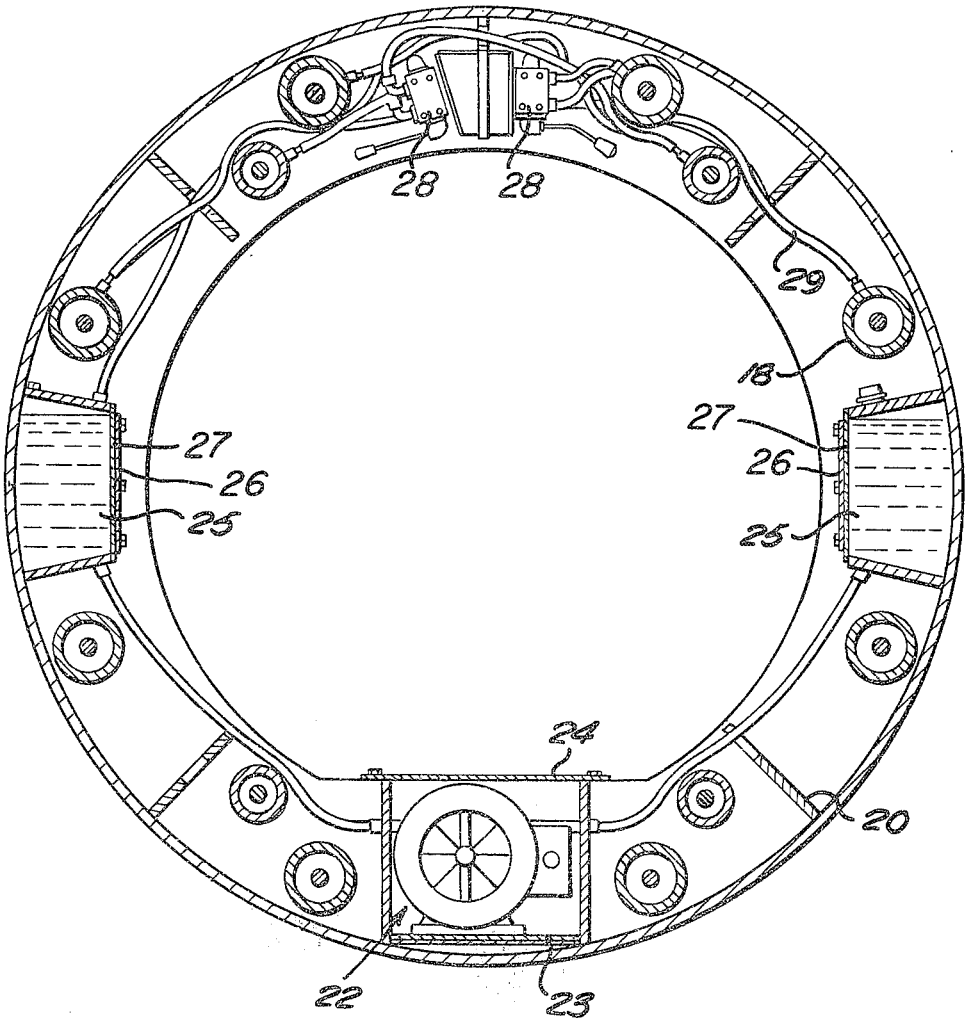
FIG. 1 is a cross-section through a tunnelling shield embodying the invention; and, FIG. 2 is an axial section through the shield of FIG. 1.
Figure 2:
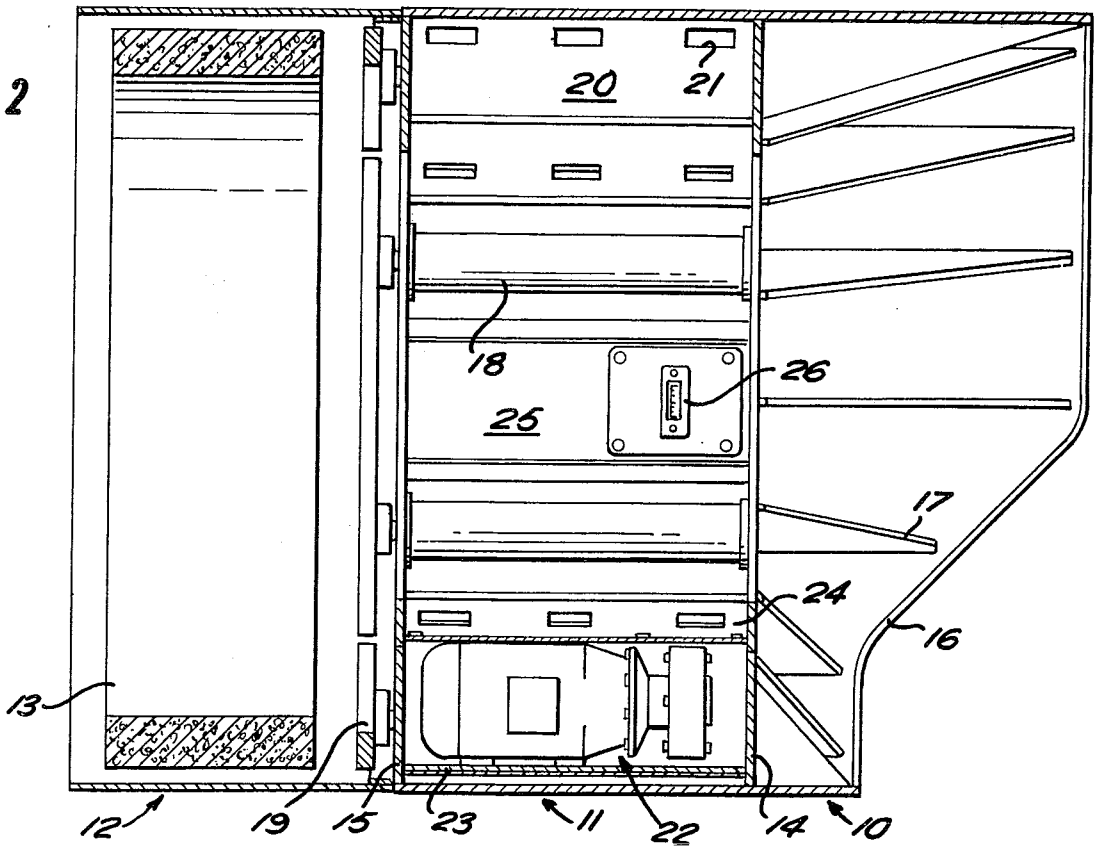

Referring to the drawings, the shield is generally cylindrical having a forward portion 10, a central portion 11, and a rear portion 12 in which the tunnel lining 13 is erected section by section as excavation proceeds. The three portions 10 to 12 are defined by two radial rings 14 and 15 the outer peripheries of which are welded to the inner periphery of the shield.

The forward portion 10 of the shield has a lower portion thereof removed so that upper and lower portions of the leading edge 16 of the shield lie in two axially offset planes and are joined by two portions extending obliquely to the axis of the shield. The forward portion 10 is strengthened by a number of generally triangular webs 17 spaced around the shield and welded at their two shorter edges to the inner periphery of the shield and the ring 14 respectively.

In the central portion 11 of the shield, a number of axially extending hydraulic rams 18 are provided spaced around the shield. The cylinders of the rams are secured at opposite ends to the rings 14 and 15 respectively. The pistons of the rams extend through respective holes in the ring 15 and carry at their free ends individual shoes 19 for thrusting against a lining 13 erected in the rear portion of the shield. A number of generally rectangular strengthening webs 20 are provided around the inner periphery of the central portion of the shield between the rams and are welded along one edge to the inner periphery thereof and at their opposite ends to the radial rings 14 and 15 respectively. The webs 20 have rectangular apertures 21 through which hydraulic coupling pipes, referred to below, extend. A hydraulic pump and motor unit 22 are located on a base plate 23 which is bolted to the inner periphery of the central portion of the shield at the bottom thereof between a part of the strengthening members 21. A cover plate 24 which provides the working floor of the shield is secured over the unit to enclose the unit, and the compartment in which the unit 22 is located is made watertight. Single or twin hydraulic tanks or reservoirs 25 are secured to the inner periphery of portion 11 of the shield at opposite ends of the horizontal diameter through the shield as viewed in FIG. 1, so that the pump and reservoirs counterbalance each other about the longitudinal axis of the shield. The reservoirs 25 are provided by channel sections secured to the inner periphery of the shield between the rings 14 and 15 which provide end walls for the reservoirs. Sight glasses 26 are provided on the cover plates 27 of the reservoirs to show the level of fluid therein.

Flow control valves 28 for controlling the operation of the rams are located in the uppermost part of the central portion 12 of the shield. Hydraulic coupling pipes 29 are provided between the tanks 25, the pump unit 22, the control valves 28 and the rams 18.

The tunnelling lining 13 is erected in the rear portion of the shield and the shield is driven forward successively by actuation of the rams to thrust the ring 19 against the lining.

It will be appreciated that since the pump unit and reservoirs are located in the strengthening of the shield, access to and from the working face through the shield is not restricted. Furthermore, since the pump unit and reservoirs are located in the strengthening of the shield, they are not exposed to the abuse normally received by the pump units of conventional equipment in which the hydraulic pump and reservoirs are towed as a unit on a sledge behind the shield.

In such conventional equipment access to the working space is restricted by the power unit mounted on a sledge. Moreover in a tunnelling shield according to the invention there are no exposed hydraulic pipes extending rearwardly of the shield so that the likelihood of breakdown is reduced.

Many modifications of the above described tunnelling shield are possible within the scope of the invention. For example, the tunnelling shield need not be hooded as described, i.e. the leading edge of the shield may lie in a plane perpendicular to the tunnel axis. Moreover, for larger diameter shields the control valves may be located adjacent a hydraulic reservoir so that they are readily accessible to an operator.

I claim:

1. In a tunnelling shield including an open-ended generally cylindrical outer wall having circumferentially spaced axially extending strengthening webs and two axially spaced radially inwardly extending annular bulkheads mounted on the inner periphery thereof, a plurality of axially extending rams fixed therein for thrusting against a tunnel lining erected behind or within the rear portion of the shield, a fluid pump, a motor for driving the pump, and at least two fluid reservoirs for supplying fluid under pressure to the rams, the improvement comprising means mounting said fluid pump and said motor on the inner periphery of said shield at the bottom portion thereof and between said two bulkheads, a valve unit including flow control valves for distributing fluid to the rams, said valve unit being mounted at the top of the shield opposite to the pump, a working floor in said shield, said pump and said motor being located beneath said working floor, and means mounting said at least two fluid reservoirs on the inner periphery of the shield located one on each side and on the transverse horizontal centerline of the shield between said bulkheads whereby said reservoirs, said pump, and said motor counterbalance each other and stabilize said shield about the central longitudinal axis thereof.

2. A shield as claimed in claim 1 wherein said containers comprise a channel-section member secured at the free edges of their limbs to the wall of the shield and extending between said two bulkheads which provide opposite end walls of the reservoirs.

3. A shield as claimed in claim 1 wherein said pump unit and said reservoirs are located between adjacent ones of said circumferentially spaced axially extending strengthening webs fixed to the inner periphery of the shield and extending between said bulkheads.

4. In a tunnelling shield including an open-ended generally cylindrical outer wall having circumferentially spaced axially extending strengthening webs and two axially spaced radially inwardly extending annular bulkheads mounted on the inner periphery thereof, a plurality of axially extending rams fixed therein for thrusting against a tunnel lining erected behind or within the rear portion of the shield, a fluid pump, a motor for driving the pump, and at least two fluid reservoirs for supplying fluid under pressure to the rams, the improvement comprising means mounting said fluid pump and said motor on the inner periphery of said shield at the bottom portion thereof and between said two bulkheads, each of said fluid reservoirs comprising an open-sided container located on the inner periphery of the shield with the wall of the shield closing the container thereby providing a wall of the reservoir, and means mounting said at least two fluid reservoirs on the inner periphery of the shield on opposite sides of and at equal distances from the bottom of the shield between said bulkheads whereby said reservoirs, said pump, and said motor counterbalance each other and stabilize said shield about the central longitudinal axis thereof.

5. In a tunnelling shield including an open-ended generally cylindrical outer wall having circumferentially spaced axially extending strengthening webs and two axially spaced radially inwardly extending annular bulkheads mounted on the inner periphery thereof, a plurality of axially extending rams fixed therein for thrusting against a tunnel lining erected behind or within the rear portion of the shield, a fluid pump, a motor for driving the pump, and at least two fluid reservoirs for supplying fluid under pressure to the rams, the improvement comprising means mounting said fluid pump and said motor on the inner periphery of said shield at the bottom portion thereof and between said two bulkheads, and means mounting said at least two fluid reservoirs on the inner periphery of the shield on opposite sides of and at equal distances from the bottom of the shield between said bulkheads, said pump unit and said reservoirs being located between adjacent ones of said circumferentially spaced axially extending strenghtening webs fixed to the inner periphery of the shield and extending between said bulkheads, and said pump unit being enclosed between the bulkheads, a pair of adjacent strengthening webs and a cover plate which provides the working floor of the shield and closes the space defined between the webs and the bulkheads whereby said reservoirs, said pump, and said motor counterbalance each other and stabilize said shield about the central longitudinal axis thereof.

6. A shield as claimed in claim 5 wherein said pump unit is located in a watertight compartment provided on the inner periphery of the shield.

* * * * *